US006170119B1

(12) United States Patent
Conrad et al.

(10) Patent No.: US 6,170,119 B1
(45) Date of Patent: Jan. 9, 2001

(54) METHOD AND APPARATUS FOR REDUCING THE SIZE OF ELONGATE PARTICULATE MATERIAL IN A VACUUM CLEANER HEAD

(75) Inventors: Wayne Ernest Conrad, Hampton; Scott Hamilton, Bowmanville, both of (CA)

(73) Assignee: Fantom Technologies Inc., Welland (CA)

( * ) Notice: Under 35 U.S.C. 154(b), the term of this patent shall be extended for 0 days.

(21) Appl. No.: 09/322,988

(22) Filed: Jun. 1, 1999

(51) Int. Cl.[7] ..... A47L 9/00
(52) U.S. Cl. ..... 15/339; 15/387
(58) Field of Search ..... 15/339, 387

(56) References Cited

U.S. PATENT DOCUMENTS

| | | | |
|---|---|---|---|
| 2,482,166 | 9/1949 | Gage . | |
| 2,703,904 * | 3/1955 | De Long | 15/387 X |
| 2,733,000 * | 1/1956 | Sparklin | 15/339 X |
| 2,789,306 * | 4/1957 | Kath | 15/339 |
| 2,789,786 * | 4/1957 | Mefford et al. | 15/387 X |
| 3,384,919 * | 5/1968 | Jording et al. | 15/339 |
| 3,968,938 * | 7/1976 | Ruhl et al. | 15/339 X |
| 4,005,526 * | 2/1977 | Clay | 15/339 X |
| 4,074,869 * | 2/1978 | Johnson | 15/339 X |
| 4,325,163 * | 4/1982 | Mattson et al. | 15/339 X |
| 4,955,107 * | 9/1990 | Kawai | 15/339 |
| 5,245,726 | 9/1993 | Rote et al. . | |
| 5,586,359 * | 12/1996 | Iida | 15/339 |
| 5,588,178 * | 12/1996 | Liu | 15/339 X |
| 5,621,945 * | 4/1997 | Howells | 15/339 |

FOREIGN PATENT DOCUMENTS

| | | | |
|---|---|---|---|
| 622654 * | 6/1961 | (CA) | 15/339 |

* cited by examiner

*Primary Examiner*—Chris K. Moore
(74) *Attorney, Agent, or Firm*—Philip C. Mendes da Costa; Bereskin & Parr

(57) ABSTRACT

A vacuum cleaner head is provided with cutting elements positioned in the air flow path of the vacuum cleaner head to reduce the size of elongate particulate material entering the dirty air inlet.

20 Claims, 12 Drawing Sheets

FIG. 10a
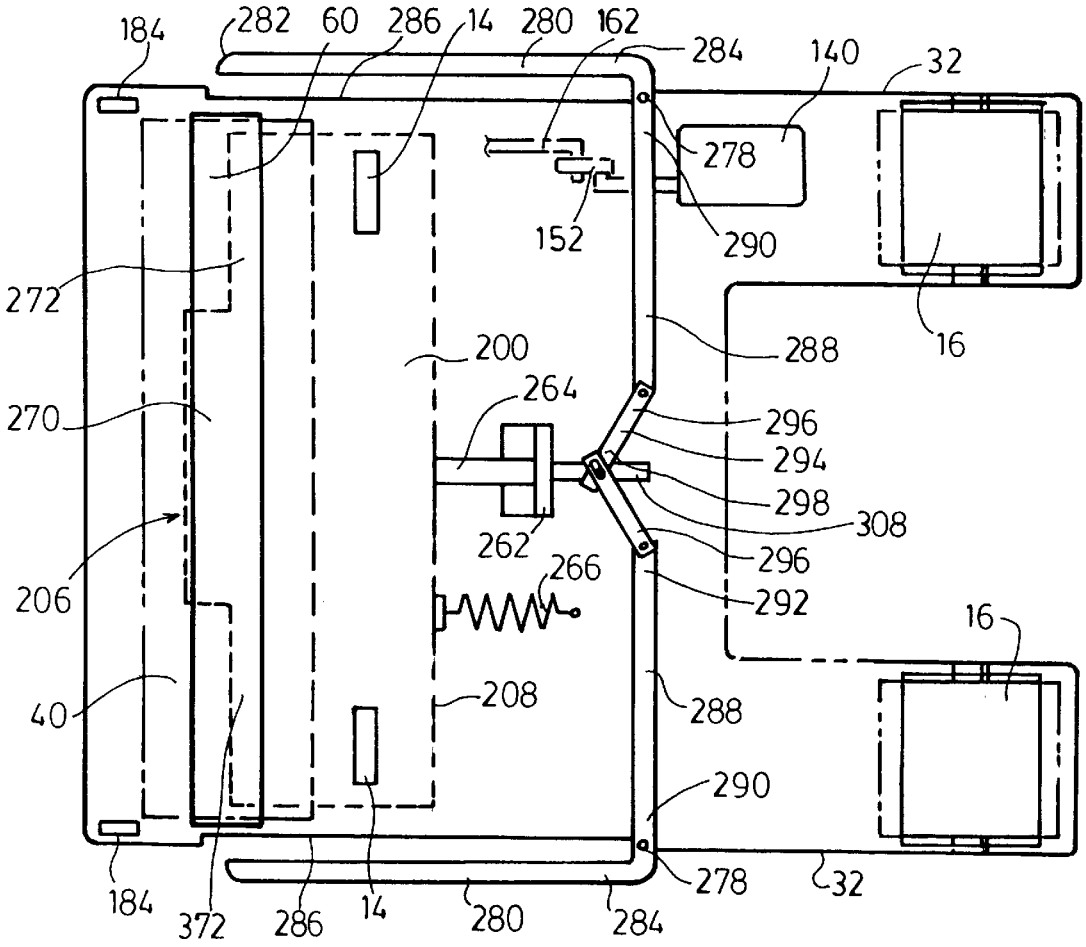
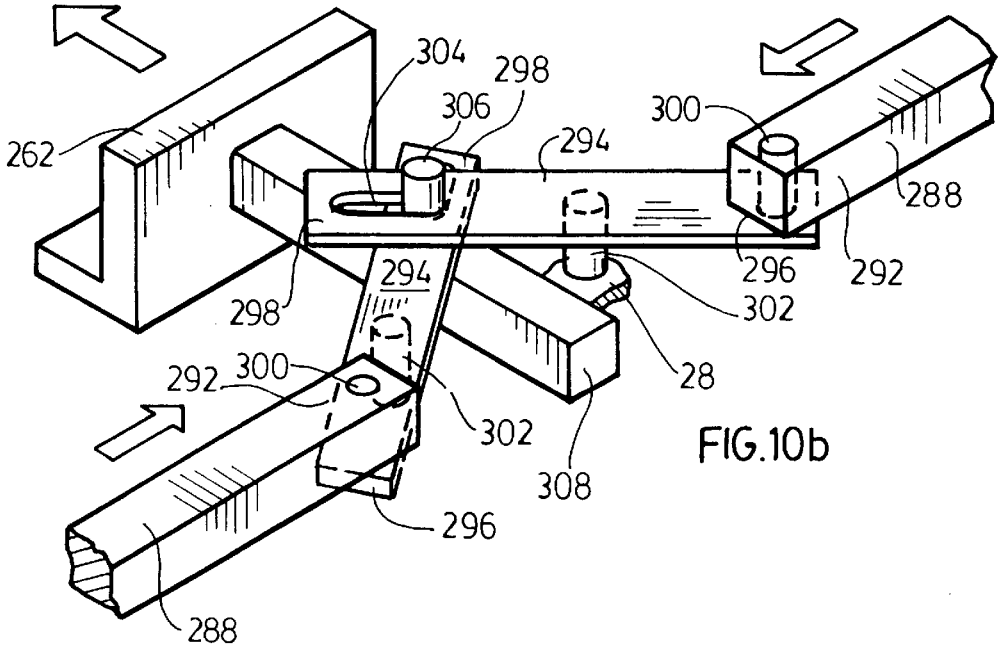
FIG. 10b 15
324
90
104
92
320
318
102
310
100
322
15

92
316
104
318
100
320
310
314
98
312
102

METHOD AND APPARATUS FOR REDUCING THE SIZE OF ELONGATE PARTICULATE MATERIAL IN A VACUUM CLEANER HEAD

FIELD OF THE INVENTION

This invention relates to vacuum cleaner heads having an agitator such as a rotatably mounted brush. Such vacuum cleaner heads may be used with upright vacuum cleaners, canister vacuum cleaners, central vacuum cleaners and the like.

BACKGROUND OF THE INVENTION

Various configuration for vacuum cleaner heads are known in the art. Vacuum cleaner heads may be used in conjunction with upright vacuum cleaners. In such a case, a vacuum cleaner head may include a motor for creating an air flow through the vacuum cleaner. In such a case, the vacuum cleaner may also be connected to an electric motor to drive a rotatably mounted brush. Alternately, a turbine driven rotatably mounted brush may be provided in the vacuum cleaner head. Similarly, in the case of canister vacuum cleaners and central vacuum cleaning systems, a rotatably mounted brush which is driven either by an electric motor or a turbine is known in the industry.

If a turbine is placed in the air flow path, it may become clogged (such as by hairs or other elongate particulate material) which may be entrained in the dirty air stream entering the vacuum cleaner head. Accordingly, it is well known in the industry to mount the turbine so as to be operated by clean air which enters the vacuum cleaner head such as through the top of the vacuum cleaner head. One disadvantage with this approach is that not all of the air which enters the vacuum cleaner head enters through the dirty air inlet. Accordingly, a portion of the suction created by the motor is used to operate the turbine and is not available for use in entraining dirt.

While it is known to locate a turbine in the dirty air flow path through the vacuum cleaner head, suitable means for preventing the clogging of the turbine have not been developed.

SUMMARY OF THE INVENTION

In accordance with the instant invention, cutting means are provided in the air flow path for reducing the size of a portion of a particulate material entering the dirty air inlet. Thus, materials such as hair and the like may be cut into smaller portions so as to avoid clogging or filing the turbine. In addition, by reducing the size of such elongate material, the likelihood of the air flow path downstream of the turbine becoming clogged is reduced. Accordingly, the efficiency of the vacuum cleaner head, and in fact the entire vacuum cleaning system, may be maintained at a higher level.

Accordingly, in accordance with the instant invention there is provided a vacuum cleaner head for cleaning a surface comprising a casing having a dirty air inlet for receiving an air flow having entrained particulate material, an air outlet and an air flow path extending between the dirty air inlet and the air outlet, a first member having a cutting edge and, a second member cooperative with the first member for reducing the size of a portion of the particulate material entering the dirty air inlet.

The first member may be mounted at a stationary position in the casing with the cutting edge positioned in the air flow path. The second member may be rotatably mounted in the casing. Preferably, the second member rotates in response to air flow through the air flow path. In such a case, the second member may cooperate with the first member as it rotates. For example, the second member may comprise a turbine positioned in the air flow path and at least some of the blades of the turbine cooperate with the first member as the turbine rotates. In such an embodiment, the first member comprises a knife which is mounted adjacent the outlet port.

The blades may be positioned whereby at any one time at most only a portion of one of the blades is cooperatively disposed with respect to the first member. Thus, the blades may comprise longitudinally extending members having a first end and a second end and the second end is rotationally displaced around the turbine with respect to the first end.

The second member may comprise a longitudinally extending member and at any one time at most only a portion of the second member cooperates with the first member.

In accordance with the instant invention there is provided a vacuum cleaner head for cleaning a surface comprising a casing having a dirty air inlet for receiving an air flow having entrained particulate material, an air outlet and an air flow path extending between the dirty air inlet and the air outlet and, cutting means positioned in the air flow path for reducing the size of a portion of the particulate material entering the dirty air inlet.

In one embodiment, the cutting means comprises a first cutting means and a second cutting means and the interaction of the first and second cutting means acts to reduce the size of a portion of the particulate material entering the dirty air inlet. The second cutting means may comprise a plurality of cutting members configured such that at any one time at most only a portion of one of the cutting members is cooperatively disposed with respect to the first cutting means. The first cutting means may be a stationary member and the second cutting means is a movably (eg. rotatably) mounted member.

The second cutting means may be a motive force means for producing motive power in response to the air flow through the vacuum cleaner head and/or used to drive a brushing means.

In accordance with the instant invention there is provided a method of cleaning a surface using a vacuum cleaner head having a dirty air inlet, an air outlet and an air flow path there between, the method comprising introducing dirty air having entrained particulate material into the dirty air inlet and, reducing the size of a portion of the particulate material as it passes through the air flow path.

The vacuum cleaner head may include a motive force means for producing motive power in response to the air flow through the vacuum cleaner head and the method further comprises using the motive force means to reduce the size of a portion of the particulate material as it passes through the air flow path. The motive force means may comprise a turbine and the method further comprises reducing the size of a portion of the particulate material as it passes by the turbine.

The method may further comprise conveying the dirty air having entrained particulate matter from the air outlet to filtration means to remove particulate matter from the air.

DESCRIPTION OF THE DRAWINGS

These and other advantages of the instant invention will be more fully and completely understood in accordance with the following description of the preferred embodiments of the invention in which:

FIG. 10*a* is a alternate embodiment of the vacuum cleaner head of FIG. 10;

FIG. 10*b* is a further alternate embodiment of the vacuum cleaner head of FIG. 10;

DESCRIPTION OF THE PREFERRED EMBODIMENT

Figure 1:
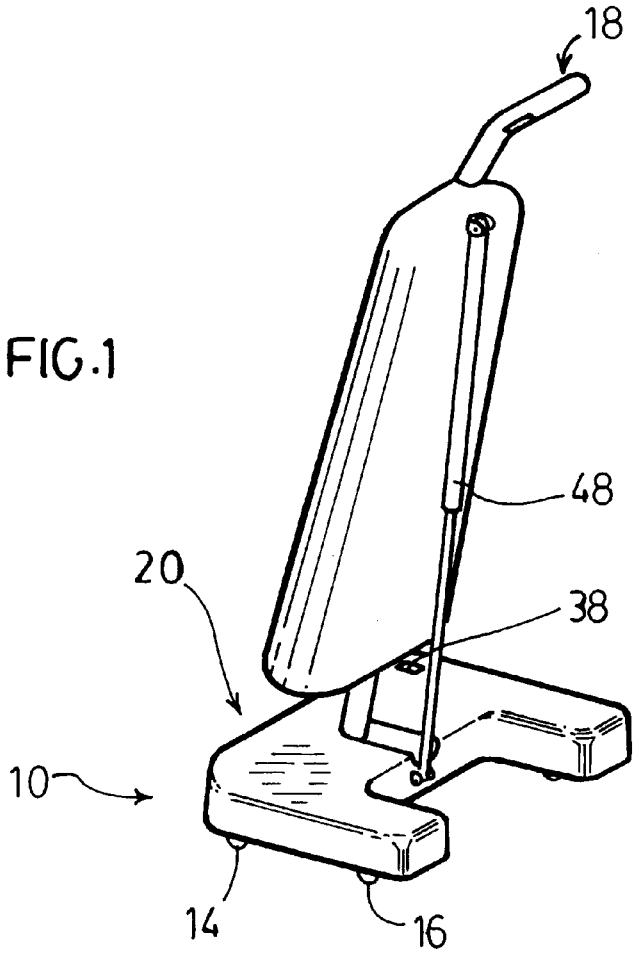
FIG. 1 is a perspective view of an upright vacuum cleaner with the upper casing in the upright storage position.
Figure 2:
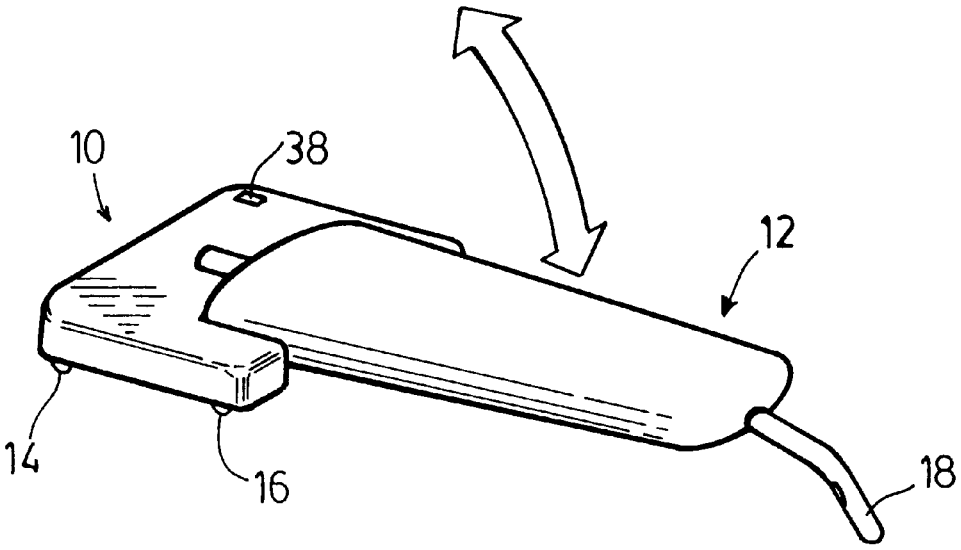
FIG. 2 is a perspective view of the vacuum cleaner shown in FIG. 1 with the upper casing in a lowered vacuuming/storage position.
Figure 5:
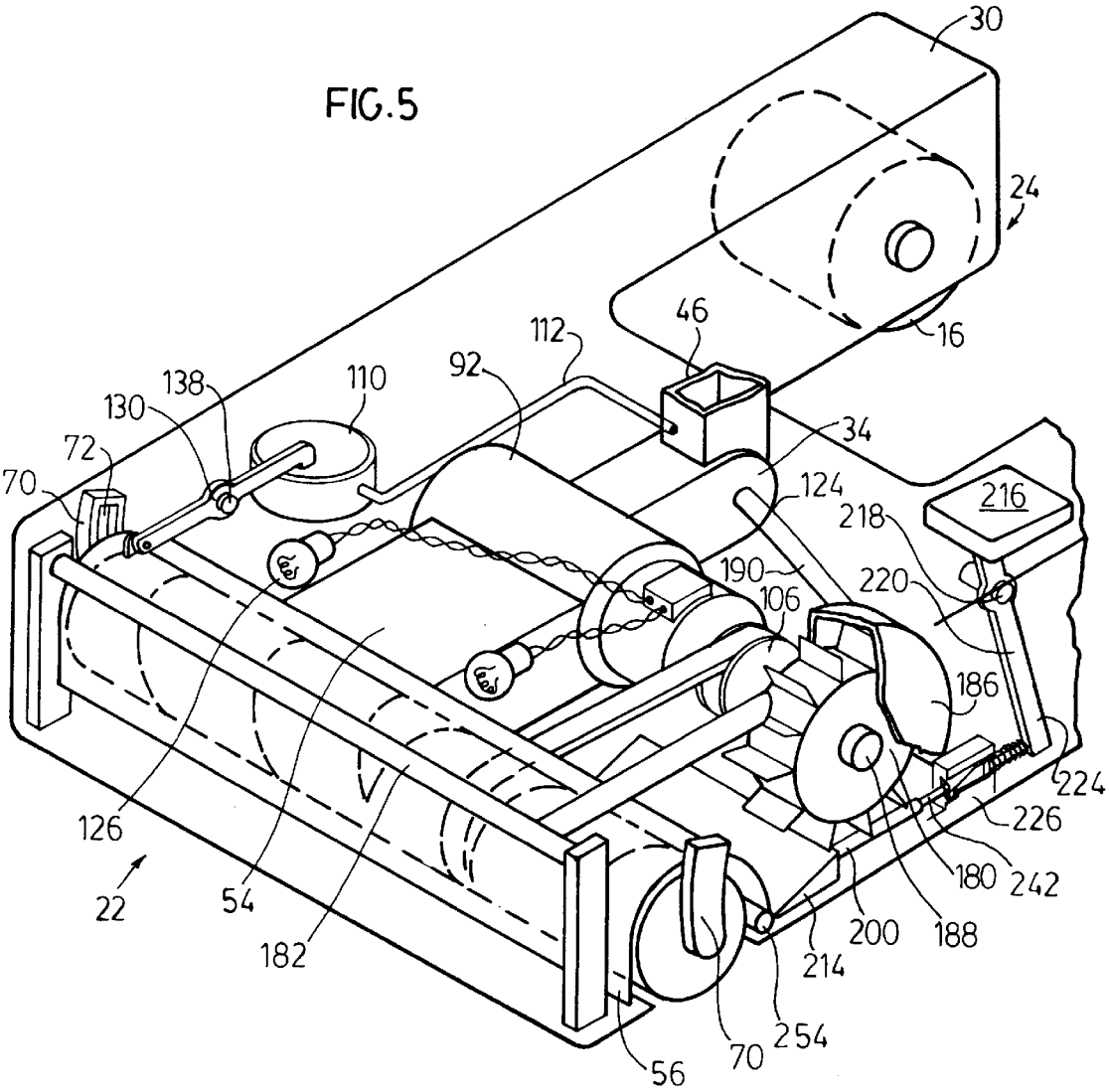
FIG. 5 is a cut away top perspective view of a second alternate embodiment of the vacuum cleaner head of FIG. 3.

According to the preferred embodiment of FIGS. 1 and 2, a vacuum cleaner comprises a vacuum cleaner head 10 and an upper casing 12. Vacuum cleaner head 10 is provided with glide means for permitting vacuum cleaner head 10 to move over a surface being cleaned (eg. front wheels 14 and rear wheels 16). Upper casing 12 is provided with handle 18 and is pivotally mounted with respect to vacuum cleaner head 10 by any means known in the art (such as by pivotal air flow conduit 34 as shown in FIG. 5). In the case of an upright vacuum cleaner, a spring may be used to offset the weight of the handle, such as compression spring 48.

Vacuum cleaner head 10 may be for use with any vacuum cleaning system known in the industry. Accordingly, vacuum cleaner head 10 may be used with an upright vacuum cleaner as shown in FIGS. 1 and 2. Alternately, for example, it may be used with a central vacuum system or with a canister vacuum system. As such, the motor for providing suction may be positioned in upper casing 12 or as part of the canister body or the central vacuum cleaning body as is known in the art. Further, it will be appreciated that vacuum cleaner head 10 may be modified to include a motor positioned therein.

The vacuum cleaner may use any dirt separation mechanism known in the industry. For example, upper casing 12 may include a filter bag or a cyclone separation mechanism.

Figure 3:
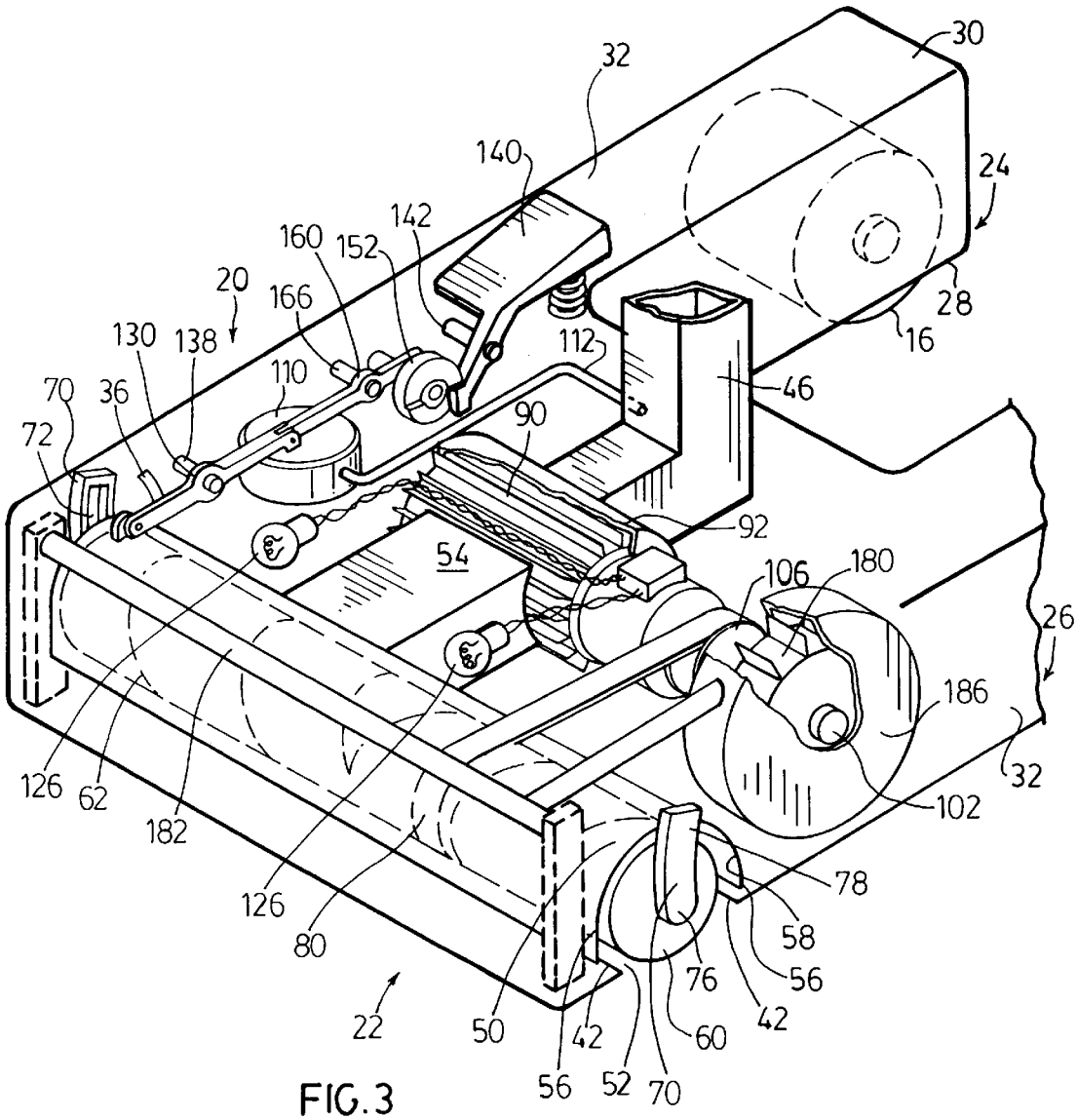
FIG. 3 is a cut away top perspective view of the vacuum cleaner head of FIG. 1.

FIG. 3 shows a cut away, top perspective view of a preferred embodiment of vacuum cleaner head 10. In this figure, vacuum cleaner head 10 comprises a casing 20 having a front end 22, a rear end 24, and spaced apart sides 26 which extend longitudinally from front end 22 towards rear end 24. Casing 20 has a lower surface 28, an upper surface 30 and side surfaces 32 extending there between. The actual shape of casing 20 may vary for design reasons and need not be of any particular size or shape.

Figure 6:
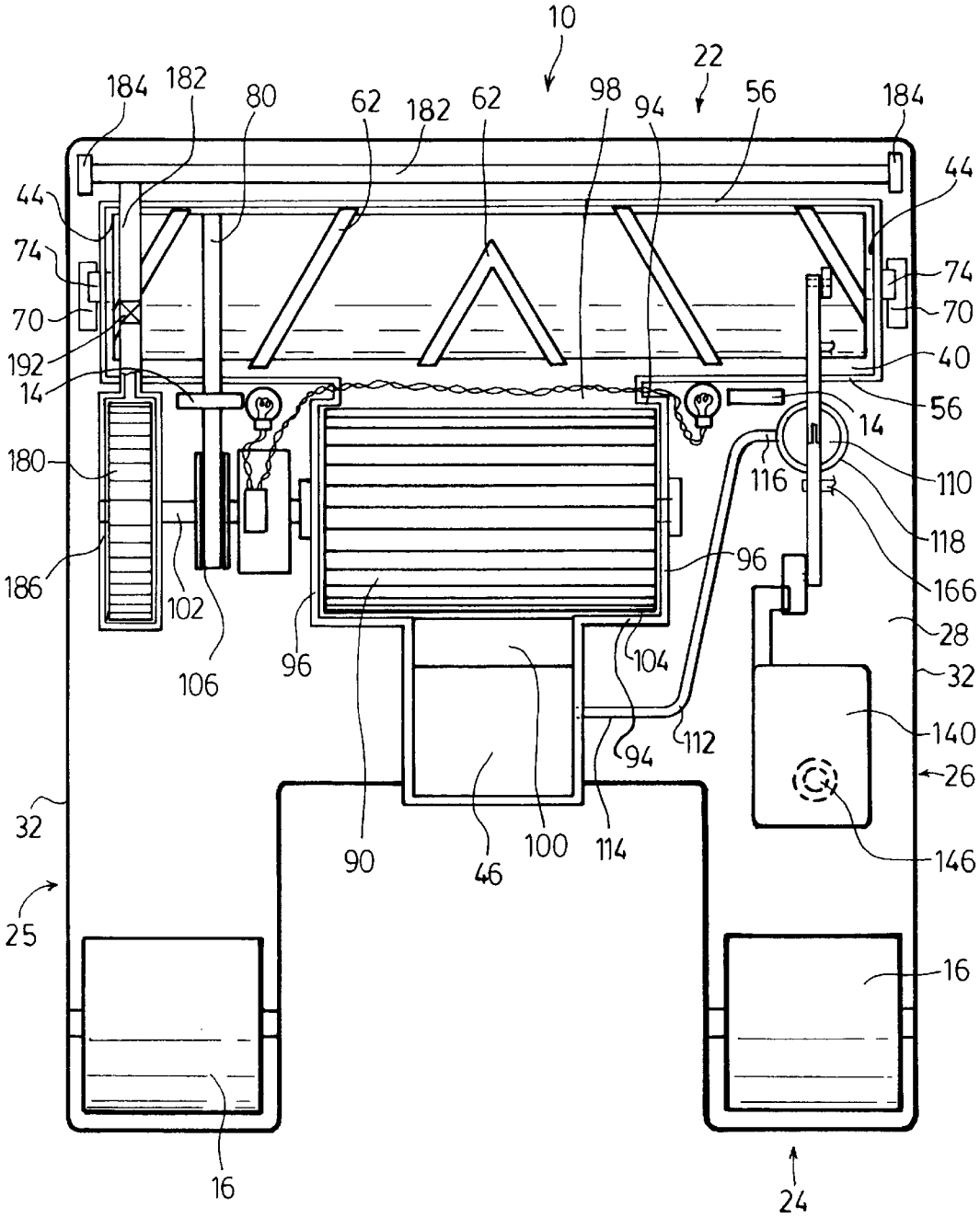
FIG. 6 is a top plan view with the upper portion of the casing removed of the vacuum cleaner head of FIG. 3.

As shown in FIG. 6, the forward position of vacuum cleaner head 10 is provided with dirty air inlet 40. Dirty air inlet 40 may be of any construction and positioning known in the art. Generally, dirty air inlets for vacuum cleaner heads comprise transversely extending openings provided in lower surface 28 having transversely extending sides 42 and spaced opposed ends 44 (see FIG. 10). Cleaner head 10 further includes a dirty air outlet 46 for connecting vacuum cleaner head 10 in air flow communication with the dirt separation mechanism which is positioned downstream thereof. An air flow path extends through vacuum cleaner head 10 between dirty air inlet 40 and air outlet 46 such that dirty air inlet 40 is in air flow communication with the dirt separation mechanism and the source of suction. Air outlet 46 may be a pivotally mounted member in casing 20 as is known in the art or it may be connectable with a pivotally moveable member.

In a preferred embodiment of this invention, vacuum cleaner head 10 may have a housing 50 for receiving a brush 60 wherein the housing is movably mounted with respect to dirty air inlet 40.

Brush 60 may be any agitation means known in the vacuum cleaner art for assisting the cleaning action of a vacuum cleaner head. It may be a stationary member or a member that is moved (eg. rotated or vibrated) so as to disturb dirt on the surface being cleaned. Preferably, brush 60 comprises a rotatably mounted brush having a plurality of bristles 62 provided thereon so as to agitate, for example, a carpet as brush 60 is rotated. Brush 60 may be rotatably mounted and rotatably driven by any means known in the art. For example, as shown in FIG. 3, brush 60 may be rotatably driven in housing 50 by means of an electric motor (as is known in the art) or by a drive belt 80. When brush 60 is rotating and in contact with the surface being cleaned the vacuum cleaner head is in a surface cleaning mode. It is also know to use vacuum cleaner to be used to clean floors having a surface which may be scratched by a rotating brush (eg. wood flooring) and for vacuum cleaners to have a nozzle provided on the end of a hose for use in cleaning, for example, furniture, crevices or the like. Vacuum cleaners may be converted to such a canister or bare floor mode by interrupting the rotation of the brush or by raising the brush while the brush is still rotating. Various means are known in the art for so converting a vacuum cleaner head.

Housing 50 may be any enclosing means mounted above the dirty air inlet for receiving brush 60 and defining an air flow path around the brush 60. Housing 50 has an air inlet 52 which is in air flow communication with dirty air inlet 40 and an air outlet 54 which is in air flow communication with the air flow path through vacuum cleaner head 10. Housing 50 may be of any particular design.

Figure 4:
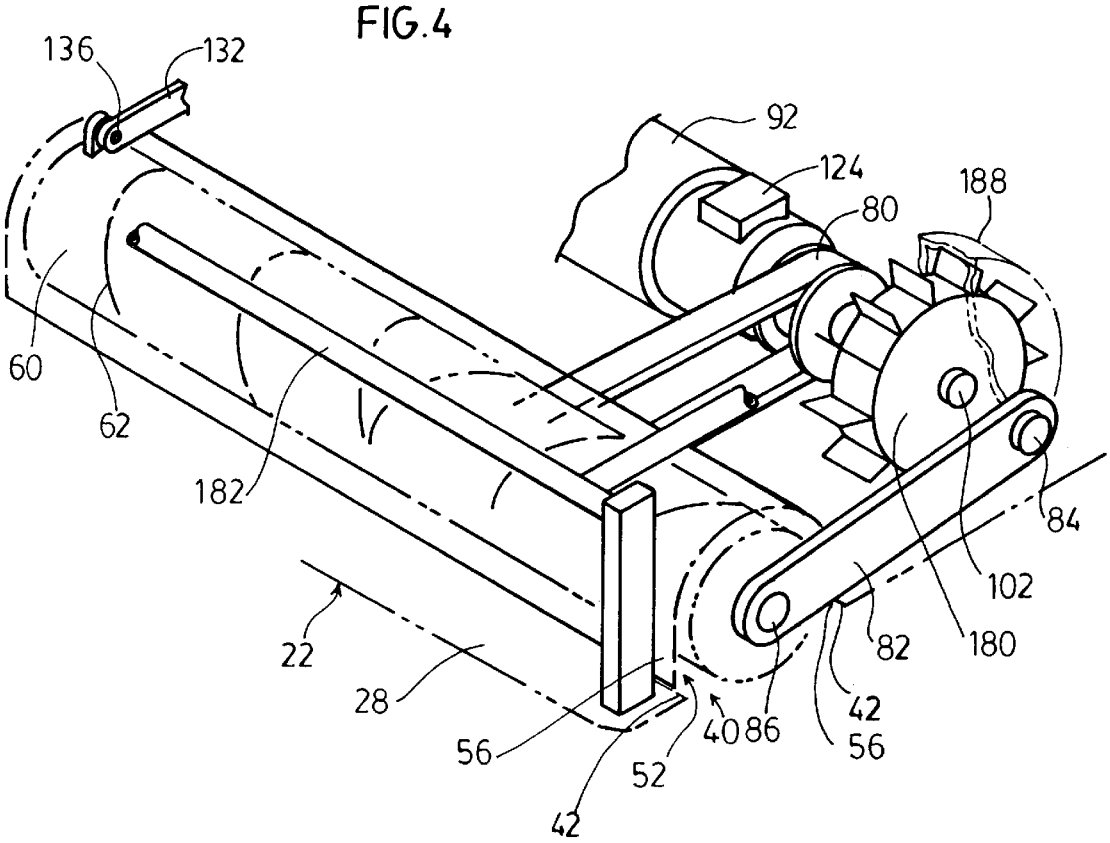
FIG. 4 is an enlarged cut away partial view of a first alternate embodiment of the vacuum cleaner head of FIG. 3.
Figure 12:
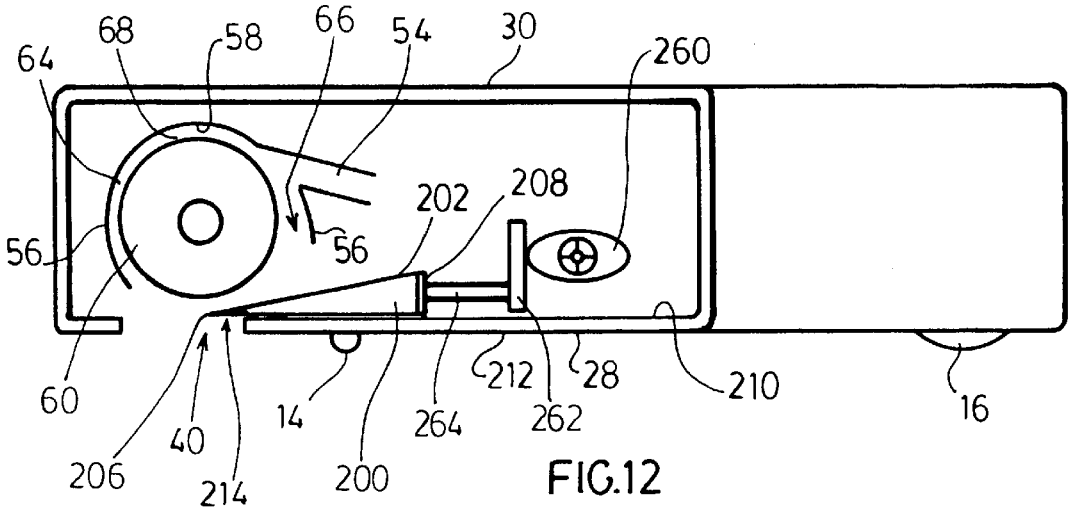
FIG. 12 is a cross section along the line of 12—12 of the vacuum cleaner head of FIG. 10.

As shown in FIGS. 4, 5 and 12, housing 50 may have spaced apart opposed sides 56 which are in air flow communication with dirty air inlet 40 and define an inner wall 58 which extends from one opposed side 56 to the other opposed side 56 and has a curved upper section. Air path 68 (which is defined as the space between brush 60 and inner wall 58 of housing 50) has an upstream portion 64 and a downstream portion 66 and extends around brush 60. Accordingly, when the source of suction is actuated, air is drawn in through air inlet 52, through air path 68 to air outlet 54 where it travels through the air flow path through vacuum cleaner head 10.

Preferably, housing 50 is aerodynamically shaped so as to assist the flow of air into the air flow path through the vacuum cleaner and around brush 60. Housing 50 may be aerodynamically shaped by positioning at least a portion of downstream portion 66 radially outwardly of brush 60 compared to upstream portion 64 of air path 68. Accordingly, a pumping action would be created as the air travels through air path 68 thus assisting the air flow through air path 68 and assisting to maintain the entrainment of suspended particulate matter and the air travelling through the air path 68.

It will be appreciated that brush 60 is preferably mounted at a fixed position in housing 50 with respect to air inlet 52. However, in an alternate embodiment, vertical movement of housing 60 with respect to housing 50 may be permitted.

Housing 50 is movably mounted with respect to dirty air inlet 40 for movement towards and away from dirty air inlet 40 and is preferably mounted above dirty air inlet 40 for vertical movement with respect to dirty air inlet 40. Accordingly, if brush 60 is mounted at a fixed position with respect to housing 50, the aerodynamic flow of air around brush 60 will be maintained as housing 50 (and accordingly brush 60) are moved to accommodate different surfaces over which vacuum cleaner head 10 travels.

Housing 50 may be movably mounted with respect to dirty air inlet 40 by any means. For example, it will be appreciated that no external member may be connected to housing 50 or brush 60. Accordingly, housing 50 may float freely upwardly and downwardly along track 70 as vacuum cleaner head 10 passes along a surface. In an alternate embodiment, as shown in FIG. 3, track 70 may be provided on the inner surface of spaced apart sides 26. Track 70 may, for example, have a slot 72 for receiving an engagement member 74 (see FIG. 6). Engagement member 74 may be an axle to which housing 50 is affixed and about which brush 60 is rotatably mounted by means of bearings which are positioned internally of brush 60 and are accordingly not shown in FIG. 6. Accordingly, brush 60 may move towards and away from dirty air inlet 40 as housing 50 travels along track 70.

Track 70 comprises a height adjustment means which allows housing 50 (and accordingly brush 60) to float freely with respect to dirty air inlet 40. It will be appreciated that vacuum cleaner head 10 may also include a lift off means for automatically adjusting the height of housing 60 (and accordingly brush 60) with respect to dirty air inlet 40 (eg. if the upper casing is moved to the upright storage position shown in FIG. 1). Alternately, a manually adjustable actuated lift-off means may be used so as to permit an operator to manually raise brush 60 (eg. by a foot operated pedal or a hand operated lever) when the brush will be running for an extended period of time with vacuum cleaner head 10 in a fixed position (such as if the vacuum cleaner is also designed to be used in a bare floor mode). Any such device known in the art to adjust the height of brush 60 may be used with housing 50.

As brush 60 moves with respect to dirty air inlet 40, the amount of tension in belt 80 may vary. Accordingly, track 70 may be shaped so as to maintain a constant tension in belt 80 as housing 50 (and accordingly brush 60) move within casing 20. To this end, as shown in FIG. 3, track 70 may have a lower portion 76 and an upper portion 78 wherein the upper portion is displaced (e.g. curved rearwardly) so as to maintain a relatively constant tension in belt 80 when brush 60 is at the upper extent of its travel in track 70.

Brush 60 may also be movably mounted with respect to dirty air inlet 40 by means of pivot arms 82 (see FIG. 4). Pivot arms 82 may be connected, for example, to the inner surface of longitudinally extending sides 26 by means of pivots 84. The opposed end of pivot arms 82 may be pivotally mounted to either housing 50 or brush 60 by means of pivots 86.

While brush 60 may be driven by any drive members known in the art, it is preferred to use a main turbine 90 which is positioned in the air flow path in vacuum cleaner head 10. As shown in FIGS. 4 and 5, main turbine 90 is rotatably mounted in main turbine housing 92. Housing 92 is sized to receive and is preferably slightly larger than main turbine 90. If main turbine 90 is a longitudinally extending member as shown in FIG. 6, then housing 92 has transversally extending sides 94 and spaced opposed sides 96 and has an inlet 98 and an outlet 100. Inlet 98 is in air flow communication with dirty air inlet 40 such as via air outlet 54 of housing 50. It will be appreciated that if vacuum cleaner head 10 does not include housing 50, that inlet 98 may be in direct communication with dirty air inlet 40. Air outlet 100 is in air flow communication with air outlet 46.

Main turbine 94 has a plurality of blades 104. When the suction source is activated, dirty air travelling through main turbine housing 92 contacts blades 104 causing main turbine 90 to rotate. Preferably, main turbine 90 is non-rotatably mounted on drive shaft 102. Further, transfer member 106 may be non-rotatably mounted on drive shaft 102 and may have a recessed portion for receiving drive belt 80. Thus, main turbine 90 is drivingly connected to brush 60 to cause rotation thereof via belt 80. It will be appreciated that other flexible drive means such as a drive chain or the like may also be used. An electric generator 124 may be used to produce electricity to operate lights 126.

Housing 50 may be provided with a flag means 38 (see FIG. 3) which is visible in window 38 of casing 20 (see FIGS. 1 and 2) when housing 50 is in the raised position. Flag means 36 may be any member that will provide a visual signal to a user, such a coloured or fluorescent coated member. In an alternate embodiment, if vacuum cleaner head 10 does not include a housing 50, as in some of the other preferred embodiments of this invention, then flag means 38 may be provided on the lift off mechanism or the brush mount.

In another preferred embodiment, vacuum cleaner head 10 includes sensing means to move brush 60 with respect to dirty air inlet 40 in response to the air pressure in the air flow path downstream of dirty air inlet 40 and, preferably, downstream of main turbine 90. Referring to FIGS. 4 and 5, a pressure sensor 100 is provided in vacuum cleaner head 10.

Pressure sensor 100 is in air flow communication with the air flow path through vacuum cleaner head 10 via passage 112 having a first end 114 and a second end 116. First end 114 may be in air flow communication with any portion of the air flow path through vacuum cleaner head 10, but, preferably, it is in communication with the air flow path downstream of housing 50 and, more preferably, downstream of main turbine 90, such as air outlet 46.

It will be appreciated that the sensing means may be used in a vacuum cleaner head 10 which does not include a housing 50. In such a case, the sensing means may still be in communication with any portion of the air flow path through vacuum cleaner head 10.

Pressure sensor 110 may be any sensing means reactive to a pressure differential that may be drivingly connected by any means known in the art to cause movement of housing 50 depending upon the air pressure in air outlet 46. If vacuum cleaner head 10 does not include a housing, pressure sensor 110 may be directly drivingly connected to brush 60 by any means known in the art. Pressure sensor 110 may be any mechanical or electrical member which is drivingly connected to housing 50 and/or brush 60 and which is responsive to the air pressure in, for example, air outlet 46 to cause movement of housing 50 and/or brush 60. Preferably, pressure sensor 110 is drivingly mechanically connected to brush 50 and/or housing 60.

Figure 7:
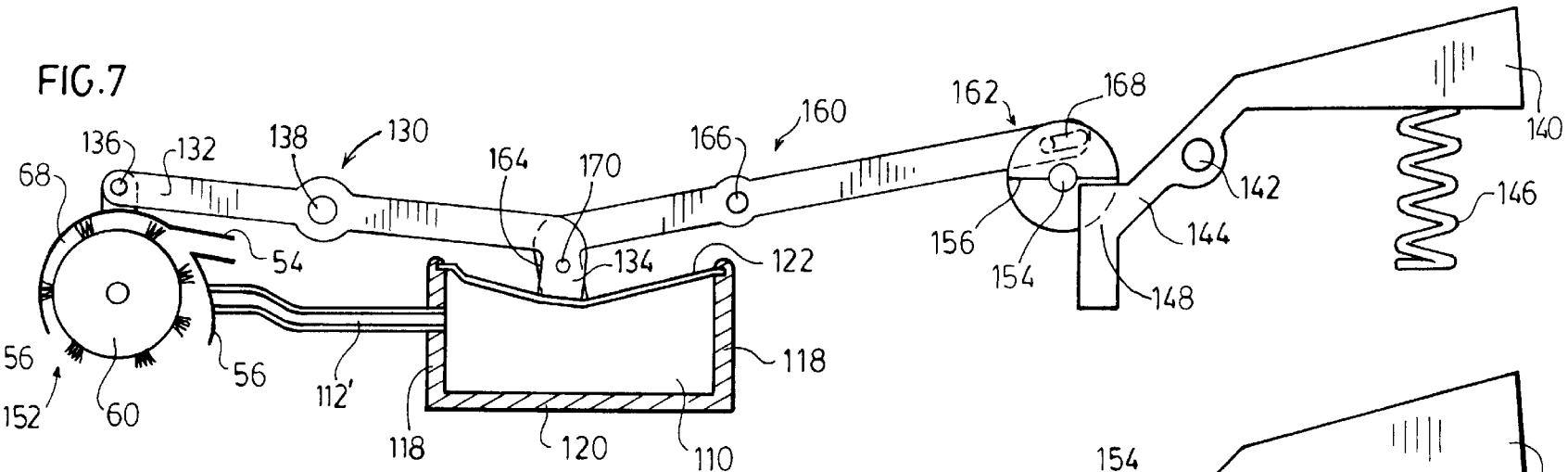
FIG. 7 is a side plan view of the lift off means for raising the brush and/or housing wherein the lift off means has been manually actuated by means of a pedal.
Figure 8:
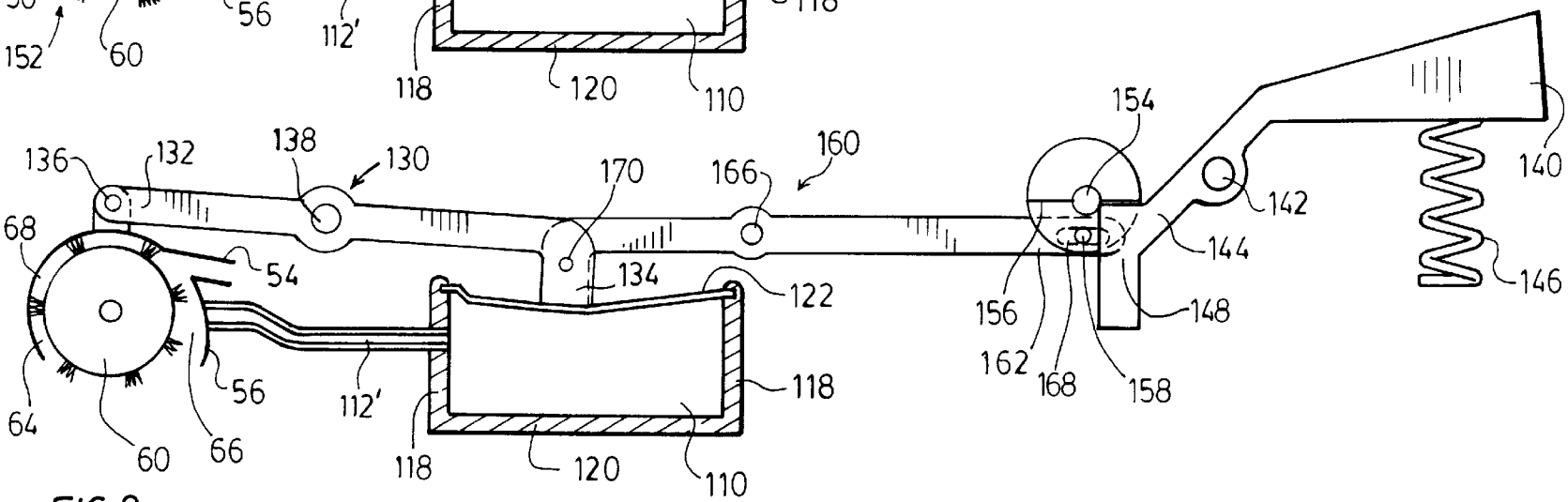
FIG. 8 is a side plan view of the lift off means of FIG. 7 wherein the housing has been raised with respect to the dirty air inlet due to a reduced pressure in the air flow path through the vacuum cleaner head.
Figure 9A:
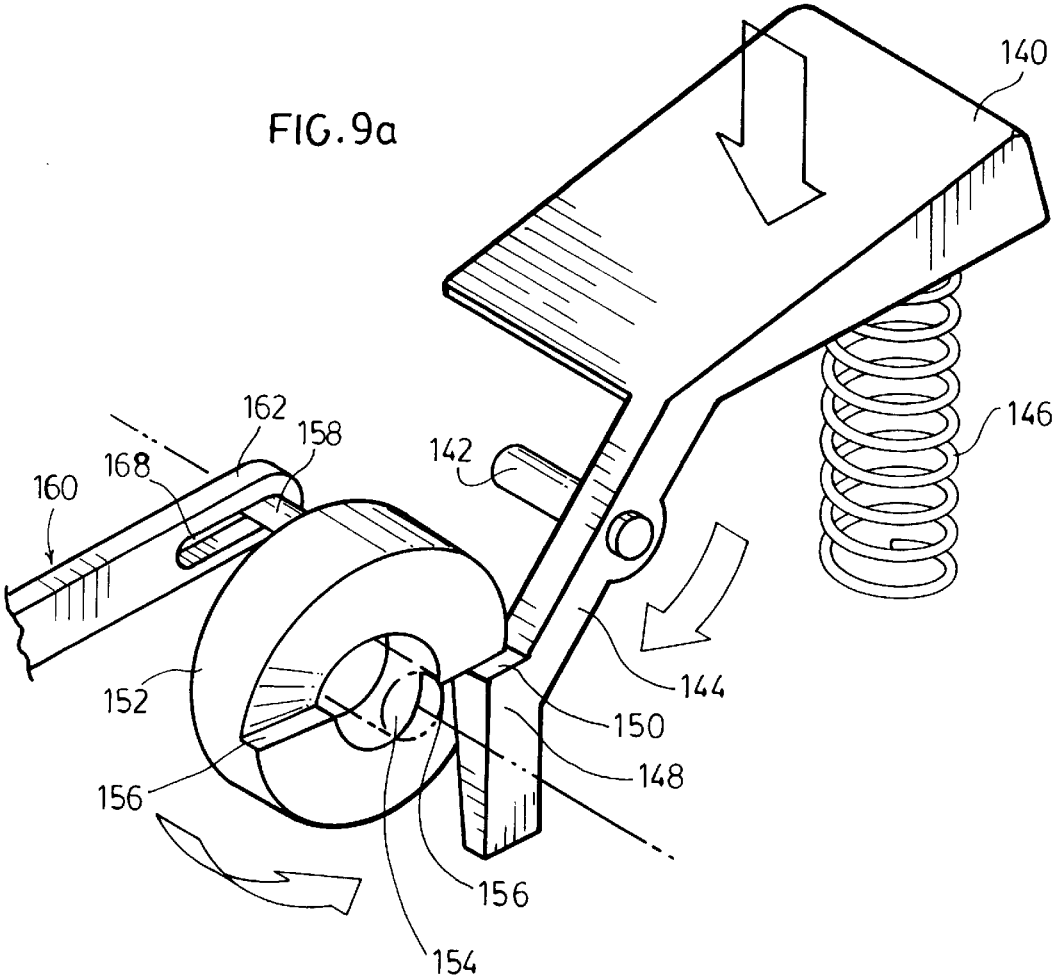
FIG. 9*a* is an enlargement of the pedal actuator for the lift off means of FIG. 6.
Figure 9:
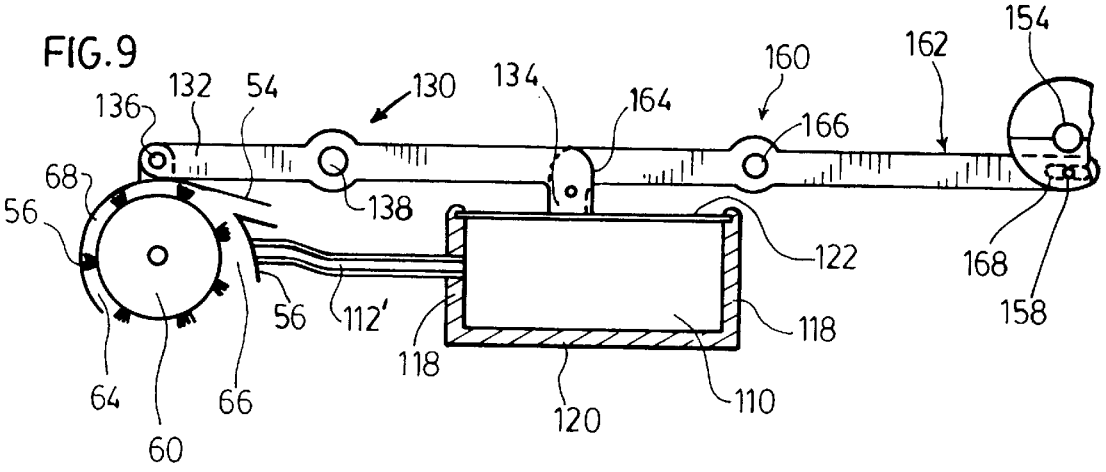
FIG. 9 is a side plan view of the lift off means of FIG. 6 wherein the housing and the brush are in a lowered ground engaging mode.

Referring to FIGS. 7–9, pressure sensor 110 is deformable member, such as a diaphragm, which will contract when the pressure in air outlet 46 is reduced. Accordingly, pressure sensor 110 may comprise a cylindrical shaped member having a rigid lower surface 120 and a peripheral wall 118. For simplicity, in FIGS. 7–9, pressure sensor 110 has been shown to be in air flow communication with air path 68 within housing 50 by means of passage 112'. It will be appreciated that the operation of pressure sensor 110 will function as long as it is in air flow communication with a portion of the air flow path through vacuum cleaner head 10. However, if this position is downstream of main turbine 90, it will be more reactive to a decreased rotation of the main turbine 90.

All or a portion of pressure sensor 110 may be deformable so as to be reduced in size when the pressure in pressure sensor 110 is reduced below a desired value. As shown in FIGS. 7–9, for example, pressure sensor 110 may have a top member 122 which is deformable. Accordingly, top member 122 may be made of a resilient material. It will be appreciated that pressure sensor 110 may be any member which contracts due to a reduced pressure in the air flow path. For example, in addition to being a deformable member, such as resilient top member 122, pressure sensor 110 may comprise a piston housing including a piston.

Pressure sensor 110 may be mechanically linked to housing 50 such as by drive arm 130. Drive arm 130 has a first end 132 which is connected to the upper portion of housing 50 via pivot 136. Drive arm 130 also has a second end 134 which abuts top member 122 of pressure sensor 110. Drive arm 130 is itself mounted for pivotable motion within casing 10 such as by pivot 138 which may extend transversely inwardly from inner surface of longitudinal side 26 (see FIG. 3). Second end 134 may be movably connected with top member 122 by any means known in the art. For example, second end 134 may be physically attached such as by an adhesive to top member 122. Alternately, it may be pivotally connected to a mounting member provided on top member 22 (not shown). By physically connecting second end 134 to top member 122, movement of top member 122 will cause the inverse motion of housing 50 due to drive arm 130 pivoting around pivot 138. Thus, if the volume of pressure sensor 110 is decreased due to a decrease in the air pressure in passage 112', then first end 136 will be raised consequentially raising housing 50 and brush 60 with respect to dirty air inlet 40.

In operation, when the vacuum cleaner is operated, the suction source will cause air to enter via dirty air inlet 40 and to travel through main turbine 90. If a blockage occurs in the air flow path (for example brush 60 picks up a large object, such as the free end of a rug) a portion of the air flow path (e.g. air path 68) will be blocked causing a reduction in the pressure in the air flow path. This reduction in pressure is transmitted via passage 112' to pressure sensor 110. In view of this pressure reduction, top member 122 deforms inwardly thus pulling second end 134 of drive arm 130 downwardly and causing housing 50 to be raised. By raising housing 50, brush 60 may be disengaged from the surface thus permitting the air flow through the dirty air path to be resumed. Thus, when the vacuum cleaner is in its normal operating mode and there is no blockage, then pressure sensor 110 will not deform permitting brush 60 to contact the surface being cleaned (see FIG. 9). However, if there is a blockage, then the increased negative pressure in the air flow path will cause pressure sensor 110 to deform (see FIG. 8). Accordingly, pressure sensor allows for the automatic adjustment of the position of housing 50 (or brush 60) with respect to dirty air inlet 40 in response to the amount of air flowing through dirty air inlet 40. Thus a dynamic response system is created using a simple mechanical linkage.

It will be appreciated that pressure sensor 110 acts as a lift off means to raise and lower the brush with respect to the dirty air inlet and may be used with or without housing 50. Further, the lift off means may be used without a main turbine 90 drivingly connected to brush 60 (in which case the brush may be any motive force means such as a motor). Optionally, vacuum cleaner head 10 may further comprise a manually adjustable control which is independent of the pressure sensor lift off means to raise and lower the brush and/or the housing when the vacuum cleaner is to be used in a bare floor cleaning mode. Such devices are known in the art. Alternately, in another embodiment, vacuum cleaner head 10 may include a manually adjustable control which is co-operatively associated with drive arm 130 whereby drive member 130 comprises a mechanical linkage which may adjust the position of the housing/brush due to a pressure differential in the air flow path or due to actuation of a manually adjustable control.

The manually adjustable control is preferably a foot operated pedal 140. Pedal 140 may be pivotally mounted to casing 20 by means of pivot 142 provided in arm portion 144. Pedal 140 may be disposed to a raised position by any biasing means known in the art such as spring 146. The end of arm portion 144 opposed to foot pedal 140 has a drive member 148. Drive member 148 comprises an abutment surface 150 (see FIG. 9*a*).

Drivenly connected to drive member 148 is ratchet wheel 152 which is rotatably mounted about axle 154. A plurality of teeth 156 are provided on one side of ratchet wheel 152 and a drive rod 158 is provided on the opposed side. Drive rod 158 is drivingly connected to first end 162 of drive arm 160. Drive arm 160 has a second end 164 which is co-operatively associated with one or both of top member 122 of pressure sensor 110 and second end 134 of drive arm 130. Drive arm 160 is pivotally mounted in casing 20 by means of pivot 166 (see in particular FIG. 3). First end 162 has an opening 168 within which drive rod 158 travels.

In operating, a person may be using vacuum cleaner head in the position shown in FIG. 9. If it is desired to raise brush 60 above the surface which is being cleaned (such as if the vacuum cleaner is to be used in a bare floor cleaning mode) the person presses downwardly on pedal 140 causing arm member 144 to rate around pivot 142 as shown in FIG. 9*a*. This rotation causes abutment surface 150 to move upwardly engaging one of the ratchet teeth 156 causing ratchet wheel 152 to rotate 180° to the position shown in FIG. 7. The rotation of ratchet wheel 152 causes drive rod 158 to also rotate 180° thus causing first end 162 to be raised upwardly. The upward movement of first end 162 causes second end 164 to move downwardly thus depressing deformable top member 122 and consequently raising housing 50. Second end 164 may be pivotally mounted to first end 134 by means of pivot 170. Spring 146 biases pedal 140 to the raised position thus preparing pedal 140 for further use. Drive rod 158 is so positioned so that downward pressure of first end 162 causes the respective ratchet tooth 156 to push downwardly on abutment surface 150 thereby preventing counter rotation of ratchet wheel 152 and maintaining the deformation of pressure sensor 110. Further actuation of pedal 140 will cause a further 180° rotation of ratchet wheel 152 resulting in ratchet wheel 152 returning to the position shown in FIG. 9. It will be appreciated that by pivotally linking drive arms 130 and 160 together, pressure sensor 110 may be actuated by a reduced pressure in the air flow path to adjust the position of brush 60 independent of the operation of pedal 140.

In accordance with another preferred embodiment, vacuum cleaner head 10 is provided with an edge cleaning turbine 182 which is drivingly connectable with a source of suction and an edge cleaning air flow path 182 positioned exterior of the dirty air inlet 40 and extending in between the edge cleaning turbine 180 and at least one opening 184 in casing 20 facing the surface which is to be cleaned. Edge cleaning turbine 180 may be positioned in an edge cleaning turbine housing 186 such that rotation of edge cleaning turbine 180 will cause the movement of air through edge cleaning air flow path 182.

Openings 184 may be positioned at any desired location in casing 20. A single opening may be provided adjacent one of the longitudinal sides 26. Preferably, as shown in particular in FIG. 6, an opening 184 is provided adjacent each longitudinal side 26. It will be appreciated that more than one opening 184 may be provided adjacent each longitudinal side 26. The openings 184 are preferably placed transversely outwardly of dirty air inlet 40 so as to travel over a portion of the surface being cleaned which is not covered by dirty air inlet 40.

The rotation of edge cleaning turbine 180 may provide increased edge cleaning in one of two modes. First, edge cleaning turbine 180 may rotate so as to direct air to enter into edge cleaning air flow path 182 and out openings 184. The outward jet of air from openings 184 agitates or assists in agitating the dirt adjacent longitudinal sides 26. Once agitated, the dirt is more easily entrained in the air flow stream entering vacuum cleaner head 10 via dirty air inlet 40. Alternately, the edge cleaning turbine may rotate in the opposite direction causing dirty air to be drawn into openings 184 and through edge cleaning air flow path 182 and then downstream of edge cleaning turbine 180 to air outlet 46. An example of this embodiment is shown in FIG. 5 wherein edge cleaning turbine 180 is mounted on an independent drive shaft 188 and passage 190 extends between edge cleaning turbine housing 186 and air outlet 46 (thus edge cleaning turbine 180 may be positioned in the air flow path through vacuum cleaner head 10 and is accordingly the source of suction directly drives edge cleaning turbine 180.). In this way, additional suction is provided adjacent longitudinal sides 26. It will further be appreciated that, based upon the size of openings 184 any the speed of rotation of edge cleaning turbine 180, the amount of suction provided adjacent edges 26 via openings 184 may be substantially greater than that through dirty air inlet 40 thus further increasing the edge cleaning efficiency of vacuum cleaner head 10. In this embodiment, all of the dirty air enters vacuum cleaner head 10 via dirty air inlet 40 and openings 184.

Main turbine 90 may be drivingly connected to edge cleaning turbine 180. For example, in the embodiment shown in FIG. 3, edge cleaning turbine 180 is non-rotatably mounted on drive shaft 102. When the source of suction is actuated, dirty air is drawn through dirty air inlet 40 and passes through main turbine housing 92 thus causing main turbine 90 to rotate. The rotation of main turbine 90 causes drive shaft 102 and air flow edge cleaning turbine 180 to rotate actuating the edge cleaning. In this embodiment, all of the dirty air enters vacuum cleaner head 10 via dirty air inlet 40 and the source of suction for the vacuum cleaner is drivingly connected to edge cleaning turbine 180 via the main turbine.

This embodiment is particularly preferred if vacuum cleaner head 10 also includes a lift off means for raising brush 60 and main turbine 90 is drivingly connected to brush 60. Then when brush 60 is raised so as not to be in contact with the surface being cleaned, a reduced amount of torque is required to rotate brush 60 thus enabling main turbine 90 to rotate at a faster rate. The faster rotation of main turbine 90 will cause edge cleaning turbine 180 to rotate faster thus increasing the amount of edge cleaning when brush 60 is raised above the surface being cleaned. For example, if vacuum cleaner head 10 includes pedal 140 to actuate a lift off means, increased edge cleaning may be obtained when pedal 140 is actuated. It will be appreciated that any other lift off means known in the art may be used in conjunction with edge cleaning turbine 180. Further, it will be appreciated that pressure sensor 110 may be included in the same vacuum cleaner head as edge cleaning turbine 110 so as to automatically raise or lower brush 60 in response to the air pressure in the air flow path downstream of dirty air inlet 40.

Optionally, the edge cleaning assembly may include a valve, such as valve 192 positioned in air flow path 182. Valve 192 may operate if edge cleaning turbine 180 is driving air through edge cleaning air flow path 182 so as to provide jets exiting via openings 184 or if edge cleaning turbine 180 is operating to draw air through openings 184. In either case, valve 192 may be set so as to operate so as to open on the triggering of an event, such as via a mechanical linkage to open when brush 60 is raised (eg. when the vacuum cleaner is in the bare floor cleaning mode). In such a case, the edge cleaning may only be actuated when desired. Alternately, valve 192 may be pressure actuated (eg. a check valve) so as to open when the pressure in edge cleaning air flow path 182 reaches a pre-set amount. This pre-set amount may be set upon a preset condition, such as brush 60 being raised thereby increasing the speed of rotation of main turbine 90 and, consequentially, edge cleaning turbine 80 thus providing increased pressure in edge cleaning air flow path 182. It will further be appreciated that passage 182 may be partially open at all times and the movement of the valve further increases the size of edge cleaning air flow path 182 thereby allowing an increase in the amount of air flow through edge cleaning air flow path 182 under desired operating conditions as discussed above.

In summary, edge cleaning air flow path 182 comprises a secondary air flow path which is positioned exterior to the air flow path which feeds main turbine 90. The air flow through the secondary air flow path is at least intermittent (e.g. if a valve 192 which completely closes air flow path 182 is provided). Means for generating an air flow through a secondary air flow path may comprise a motor drivingly connected to edge cleaning turbine 180, air flow created by suction through vacuum cleaner head 10 via air outlet 46 or drivingly connecting main turbine 90 to edge cleaning turbine 180. Edge cleaning turbine 180 may rotate at the same speed as main turbine 90 or at a different rate. For example, edge cleaning turbine 180 may be non-rotationally mounted on a second shaft which is connected by gearing means to shaft 102. By selecting different size gears for the different shafts, rotation of drive shaft 102 may cause edge cleaning turbine 180 to rotate at a faster speed.

Figure 5A:
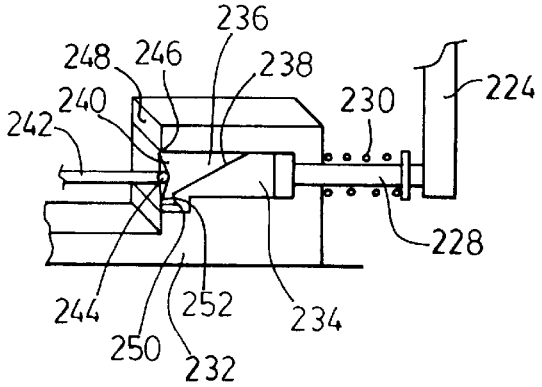
FIG. 5*a* is an enlargement of a portion of the vacuum cleaner head of FIG. 5.

Referring to FIGS. 5, 5*a,* 10, 10*a,* 10*b,* 11, 12 and 13, another preferred embodiment of vacuum cleaner head 10 is shown. In this embodiment, vacuum cleaner head 10 includes a restricting member 200 having an upper surface 202, a lower surface 204, a front end 206 and a rear end 208. Restricting member is operable between a neutral position in which restricting member 200 does not interfere or at least does not significantly interfere with the air flow entering dirty air inlet 40 (see for example FIG. 13) and a restricting position in which restricting member 200 is positioned so as to reduce the size of dirty air inlet 40 (see for example FIG. 12). By reducing the size of dirty air inlet 40, the velocity of the air travelling through dirty air inlet 40 will increase thus assisting the air travelling beneath lower plate 28 to entrain additional dirt and/or larger particles of dirt. Accordingly, the efficiency of vacuum cleaner head 10 will be increased.

Figure 13:
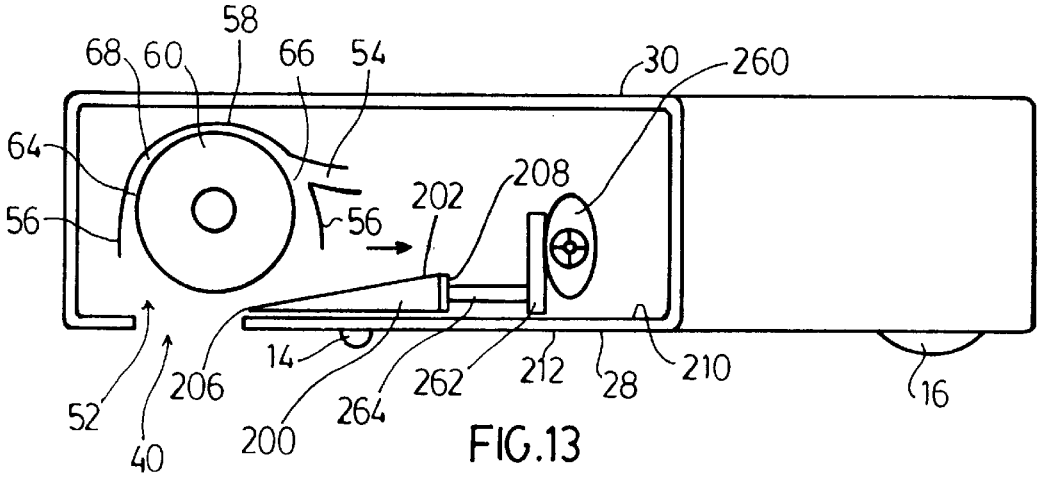
FIG. 13 is a cross section along the lines of 13—13 of the vacuum cleaner head of FIG. 11.

Restricting member 200 may be positioned anywhere in vacuum cleaner head 10 which will result in the velocity of air entering dirty air inlet 40 being increased. If vacuum cleaner head 10 includes a brush 60, that restricting member 200 may be positioned at any point wherein it is operable to assist in the flow of dirty air around brush 60. Preferably, as shown in FIGS. 12 and 13, restricting member 200 is positioned beneath brush 60 when in the restricting position. It will be appreciated that restricting member 200 may be positioned adjacent upper surface 210 of lower plate 28 or adjacent lower surface 212 of lower plate 28. However, restricting member 200 is preferably positioned immediately above lower plate 28.

Restricting member may be of any particular shape provided it co-operates with casing 20 (eg. lower plate 28) to reduce the size of dirty air inlet 40. Accordingly, as shown in FIG. 12, restricting member 200 may be generally wedge shaped. Alternately, as shown in FIG. 5, restricting member 200 may be a generally planar member having a wedge shaped front portion 214. The angled forward portion assists restricting member 200 to travel longitudinally underneath brush 60 so as to cooperate with plate 28 to reduce the size of dirty air inlet 40. However, it will be appreciated that restricting member 200 may be of any particular shape.

Figure 10:
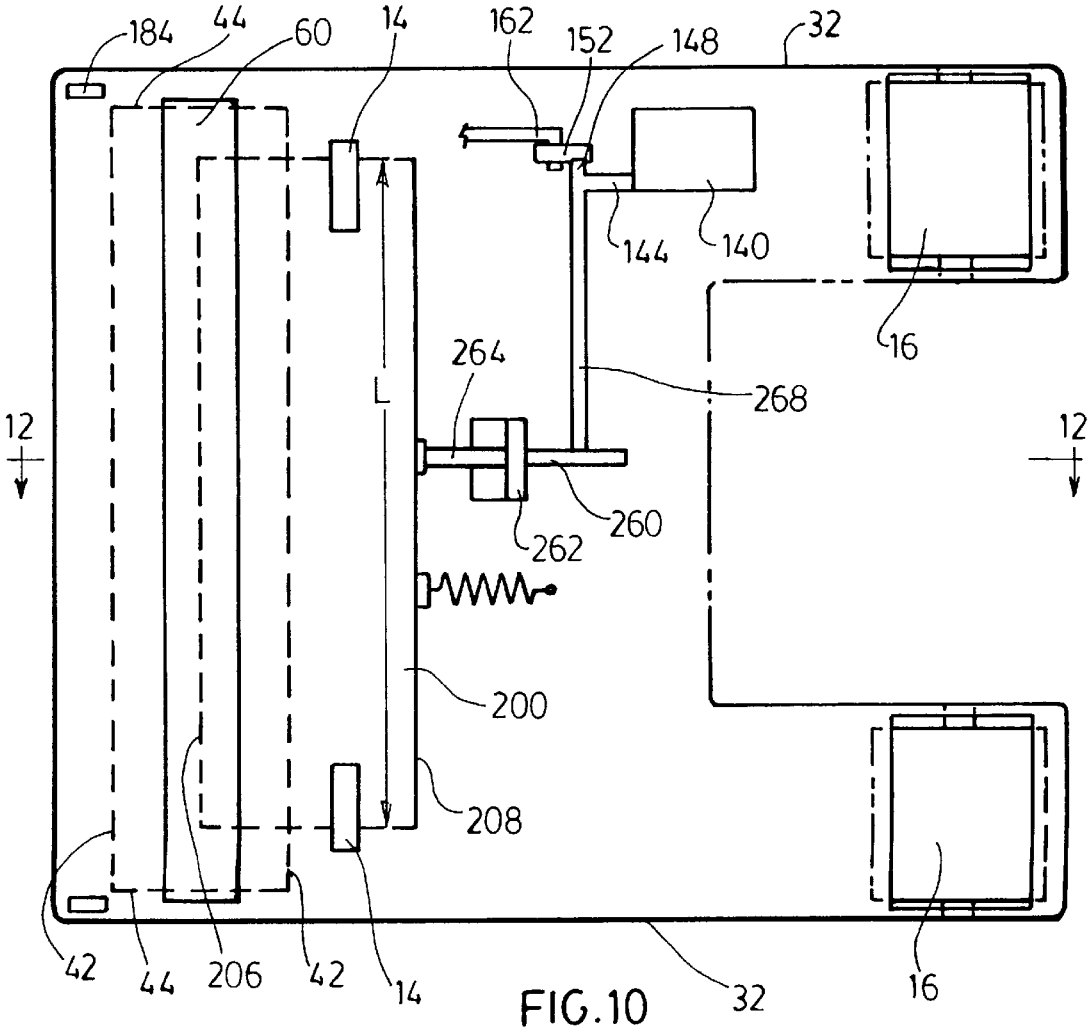
FIG. 10 is a top plan view of an alternate embodiment of the vacuum cleaner head of FIG. 1 wherein the turbine, brush housing and a portion of the lift off means have been removed and the restricting member is in the restricting position.

Restricting member 200 may be movable between the neutral position and the restricting position by any control means known in the vacuum cleaner art (such as foot pedal which have been used to actuate a lift off mechanism for a brush). For example, as shown in FIG. 5, pedal 216 may act as a control member which is drivingly connected to restricting member 200 to move it between the neutral and restricting positions. Alternately, as shown in FIG. 10, pedal 140 may be a control member which is drivingly connected to operate both the lift off means for the brush/housing as well as restricting member 200. It will further be appreciated that restricting member 200 may be moved by manual control (such as a hand operated slidably movable control knob) positioned on the outside of casing 20 or, restricting member 200 may be mechanically linked to either housing 50 or brush 60 to move to the restricting position when the housing/brush are raised to the bare floor cleaning mode. Further, restricting member 200 may be biased, such as by means of a spring, to move to the restricting position when housing 50 or brush 60 is moved to the bare floor cleaning position (not shown). By linking the lift off means and restricting member 200, restricting member 200 may be actuated when vacuum cleaner head 10 is converted to the bare floor cleaning mode. As brush 60 is not used to disturb the dirt on the surface being cleaned in the bare floor cleaning mode, the increased velocity of the air entering dirty air inlet 40 assists in the cleaning of the surface in this mode.

Referring to FIG. 5, pedal 216 may be of a similar construction to pedal 140. Accordingly, pedal 216 may have an arm portion 220 which is pivotable mounted about pivot 218 and may be biased to end raised position by means of spring 230. The distal end of arm portion 220 opposed to pedal 216 is provided with drive member 224. Drive member 224 is drivingly connected to locking means 226. Any locking member known in the art could be used. In the embodiment of FIG. 5, locking means 226 comprises a drive rod 228 which is biased to the first position shown in FIG. 5 by means of, for example, spring 230. Rod 228 travels longitudinally in bore 234 of housing 232. Also positioned within bore 234 is locking member 236. In this embodiment, locking member 236 has an engagement end 238 and drive end 240 which is drivingly connected to rear end 208 of restricting member 200 such as by transfer rod 242 which is pivotally connected by means of pivot 244 to drive end 240.

Locking member 236 is provided with a first engagement surface 246 for engagement with first engagement surface 248 of housing 232. Similarly, locking member 236 is provided with a second engagement surface 250 for engagement with second engagement surface 252 of housing 232.

In operation, when pedal 216 is depressed downwardly, drive end 224 displaces drive rod 228 forwardly overcoming the resistance of spring 230 and engaging engagement end 238 of locking member 236. This forward motion will cause locking member 236 to travel forwardly disengaging drive end 240 from engagement surface 248 of housing 232 and causing drive end 240 to pivot about transfer rod 242. When the pedal is released, spring 230 will cause drive rod 228 and pedal 216 to return to their starting positions. This rearward motion of drive rod 228 permits locking member 236 to move rearwardly resulting in engagement surface 250 to engage engagement surface 252 of housing 232.

In this embodiment, restricting member 200 is drivingly connected to housing 50. The forward motion of restricting member 200 causes housing 50 to move upwardly thus raising brush 60. As restricting member 200 travels forwardly, wedge shaped front portion 214 engages the bottom of the rearward spaced apart opposed side 56. The continued forward motion of restricting member 200 forces housing 50 upwardly. In order to assist this interaction, a cam surface may be provided. For example, cam member 254 may be positioned on opposed side 56 so as to ease the travel of restricting member 200 underneath housing 50. In this way, restricting member 200 is drivingly connected to brush 60 to move brush 60 with respect to dirty air inlet 40. It will further be appreciated that, in the embodiment of FIG. 3, if restricting member 200 were biased to the forward position, the engagement between opposed side 56 and restricting member 200 may be used to cause restricting member 200 to move rearwardly to the neutral position as brush 60 moves downwardly due to the operation of pedal 140. In such a way, brush 60 may be drivingly connected to restricting member 200.

In the embodiment of FIGS. 10 and 12, pedal 140 is drivingly connected to both brush 60 and restricting member 200. In FIG. 10, the mechanical linkage between drive arm 160 and housing 50 has not been shown but it may be the same as in FIG. 6. The drive mechanism comprises ratchet wheel 260, wall 262, drive rod 264 and spring 266. Ratchet wheel is elliptical in shape. When in the position shown in FIG. 12, the long axis of ratchet wheel 260 is horizontally disposed. Accordingly, wall 262 has been displaced forwardly thereby driving restricting member 200 forwardly. Spring 266 may be any biasing means which biases restricting member 200 rearwardly. Accordingly, when ratchet wheel 260 is rotated to the position shown in FIG. 13 wherein the long axis is vertically disposed, wall 262 cams along the peripheral surface of ratchet wheel 260 thereby allowing spring 266 to move restricting member 200 rearwardly. Ratchet wheel 260 may be drivenly connected to pedal 140 by any means known in the art such as by a drive rod 268 which interacts with ratchet wheel 260 to move ratchet wheel 90 degrees each time pedal 140 is depressed.

Restricting member 200 is a transversely extending member which may have many particular transverse length "L". Preferably, restricting member 200 has a transverse length which comprises a major proportion to the transverse length of dirty air inlet 40. More preferably, restricting member 200 has a transverse length L which is the same or substantially the same as that of dirty air inlet 40 (see for example FIG. 10).

Figure 10C:
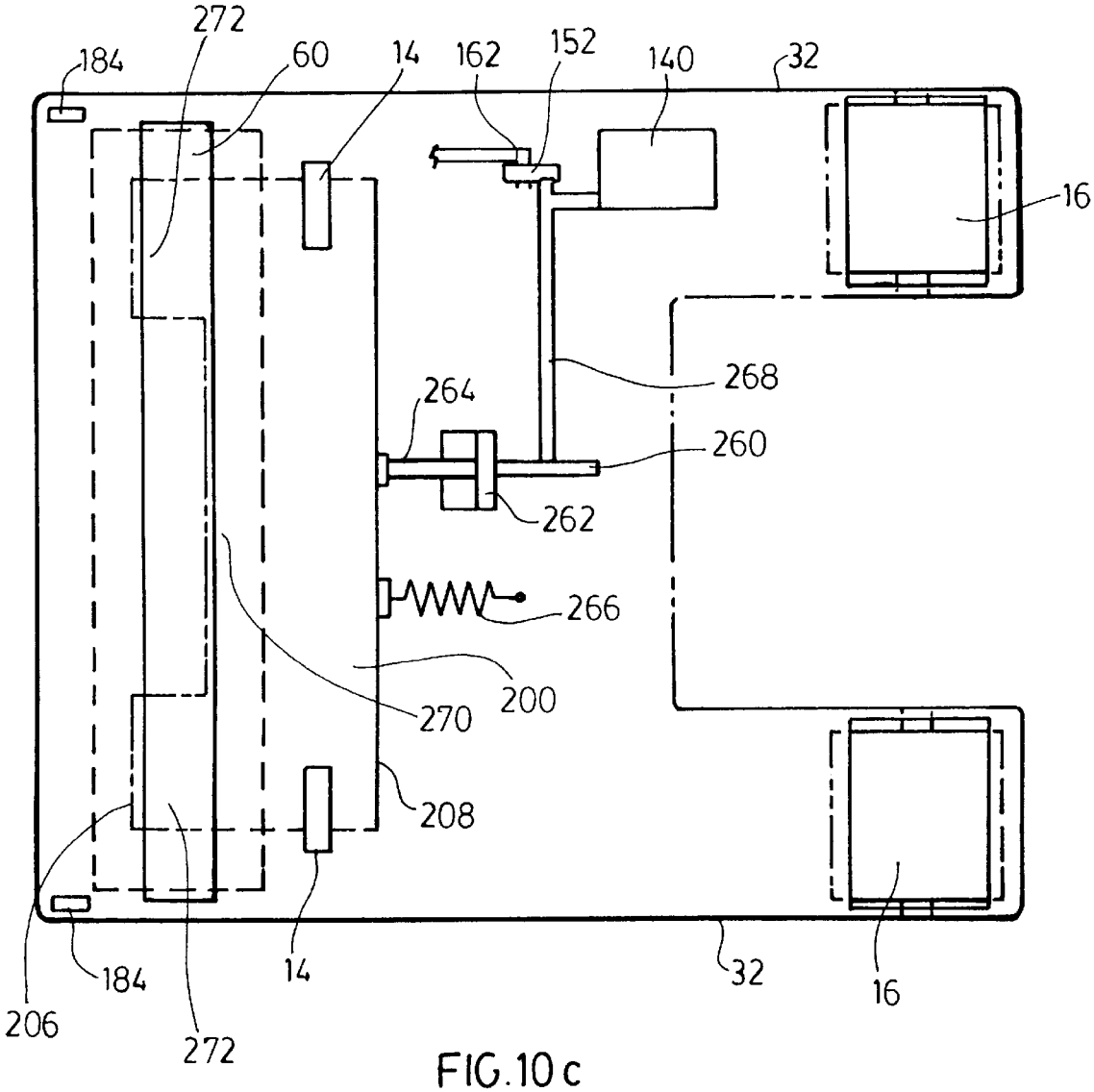
FIG. 10*c* is a further alternate embodiment of the vacuum cleaner head of FIG. 10.
Figure 11:
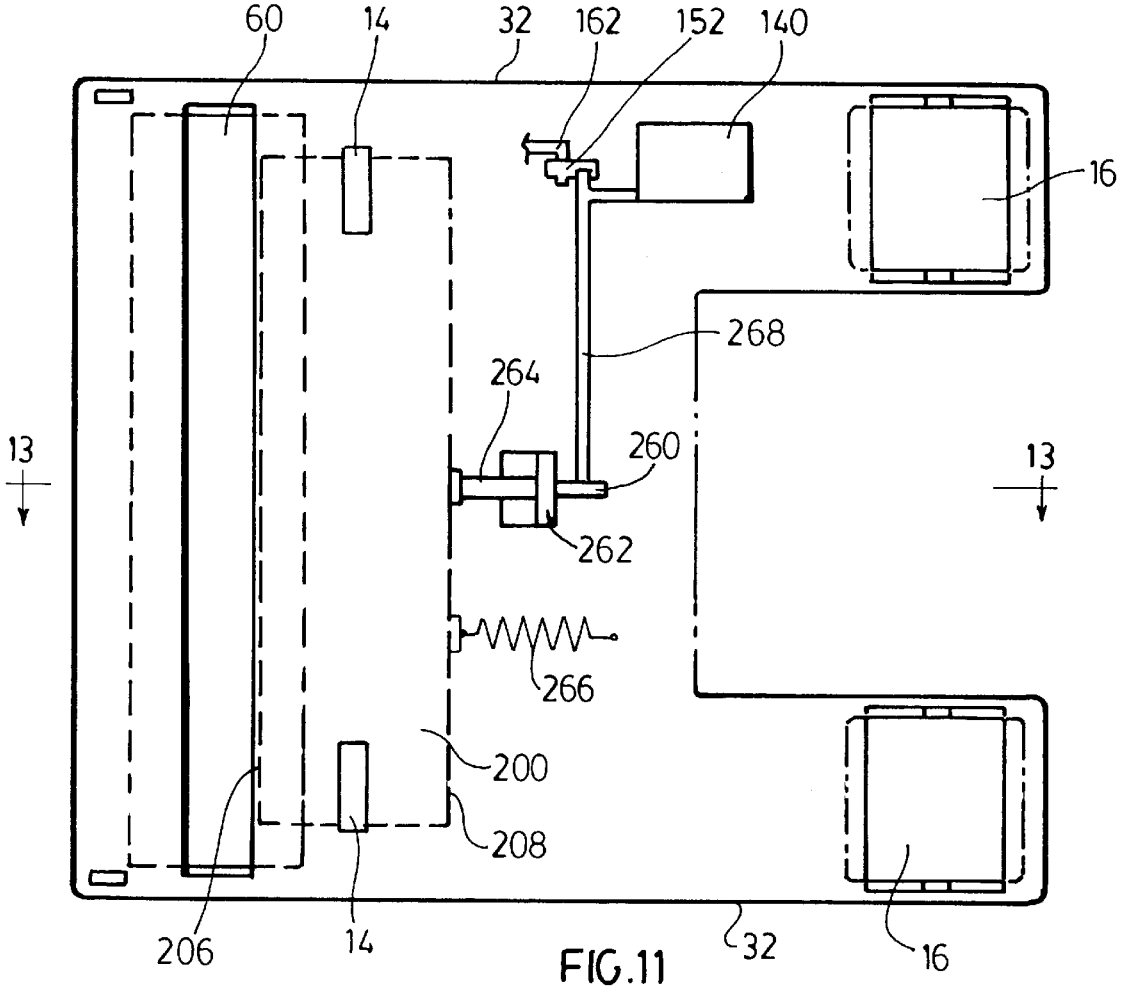
FIG. 11 is a top plan view of the vacuum cleaner head of FIG. 10 with the restricting manner in the neutral position.

In the embodiment of FIG. 10, forward end 206 of restricting member 200 comprises a generally transversely extending line. Accordingly, at any position along the transverse extent of dirty air inlet 40, a uniform amount of dirty air inlet 40 is blocked by restricting member 200. However, it will be appreciated that forward portion 206 may have any particular shape. For example, in the embodiment shown in FIG. 10*a,* forward portion 206 has a central portion 270 (which defines a respective central portion of dirty air inlet 40) and transversely spaced apart side portions 272 (which respectively define side portions of dirty air inlet 40). In this embodiment, central portion 270 has a forward longitudinal extent greater than the forward longitudinal extent of side portions 272. Accordingly, when restricting member 200 is in the restricting position shown in FIG. 10*a,* central portion 270 blocks a greater amount of the central portion of dirty air inlet 40 than side portions 272 block of the side portions of dirty air inlet 40. Thus, restricting member 200 will cause a greater proportion of the air to enter vacuum cleaner head 10 via the side portions of dirty air inlet 40 thus increasing the edge cleaning of vacuum cleaner head 10. In the embodiment shown in FIG. 10*c,* side portions 272 have a forward longitudinal extent greater than the forward longitudinal extent of central portion 272. Accordingly, when restricting member 200 is in the restricting position shown in FIG. 10*c,* a greater proportion of the air will enter vacuum cleaner head 10 via the central portion of the dirty air inlet 40 thus concentrating the cleaning action of vacuum cleaner head 10 at the central portion of dirty air inlet 40.

In another embodiment of the instant invention as shown in FIG. 10*a,* the enhanced edge cleaning may be actuated by a control member 280 which is engageable with the area being cleaned (for example a vertically extending member, eg. wall, table leg, etc. of the area being cleaned). The control member may be drivingly connected to any edge cleaning means known in the art. Preferably, it is drivingly connected to one or more of the edge cleaning features discussed above. Thus control member 280 may be operatively connected to actuate restricting member 200, edge cleaning turbine 180, ratchet wheel 152 so as to raise housing 50 (and increase of speed of rotation of edge cleaning turbine 180) when control member 280 is actuated or to valve 192 so as to open valve 192 when control member 280 is actuated. Accordingly, when a person is cleaning using vacuum cleaner head 10, contact between one of the longitudinal sides 26 of vacuum cleaner head 10 and, e.g., a wall of a house will actuate the increased edge cleaning.

As shown in FIGS. 10*a* and 10*b,* control member 280 comprises a longitudinally extending member having a front end 282 and a rear end 284. It will be appreciated that a control member 280 may be provided on each longitudinal side 26 of vacuum cleaner head 10. Control member 280 is preferably constructed so as to travel inwardly to actuate the advanced edge cleaning of vacuum cleaner head 10. Accordingly, for example, longitudinal side 26 may be provided with a recess 286 which is sized for receiving therein control member 280. Rear end 284 is connected to outer end 290 of first linking member 288 which are mounted for pivotal motion as forward end 282 moves inwardly (such as by pivot 278). Outer end 296 of second linking member 294 is pivotally connected to inner end 292 of first linking member 288 by means of pivot 300. Second linking member 294 is pivotally mounted about pivot post 302 which may be secured, for example, to lower plate 28. Inner end 292 has an opening 304 for receiving drive rod 306 which is connected to push rod 308. Accordingly, when vacuum cleaner head 10 engages a wall, table leg or the like, front end 282 of control member 280 moves inwardly causing inner end 292 of first linking member 288 to move rearwardly. As outer end 296 of second linking member 294 is connected to inner end 292, outer end 296 of second linking member 294 will also move rearwardly and cause inner end 298 to move forwardly. This forward movement will cause restricting member 200 to move forwardly due to the contact between drive rod 306 and inner end 298. It will be appreciated that if restricting member is biased rearwardly (such as by spring 266), when control member 280 is no longer forced inwardly by an external force, spring 266 will pull restricting member 200 rearwardly thereby driving control member 280 back to its starting position.

It will be appreciated as discussed above that if restricting member 200 is drivingly connected to brush 60 or housing 50, the forward motion of restricting member 200 may raise brush 60. Further, if edge cleaning turbine 180 is drivingly connected to main turbine 90, raising brush 60 from contact with the surface being cleaned will caused an increased air flow to travel through edge cleaning air flow path 182 thereby enhancing the edge cleaning function of vacuum cleaner head 10.

Figure 14:
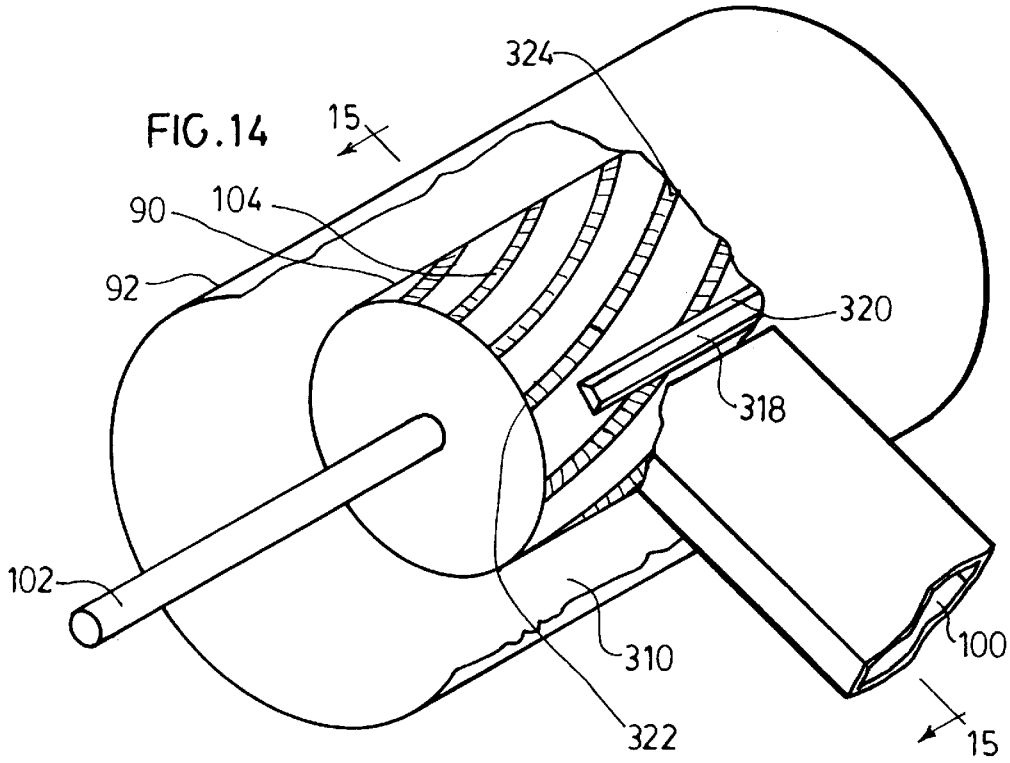
FIG. 14 is a perspective view of an alternate embodiment of the turbine and turbine housing shown in FIG. 3; and, FIG. 15 is a cross section along the line 15—15 in FIG. 14.
Figure 15:
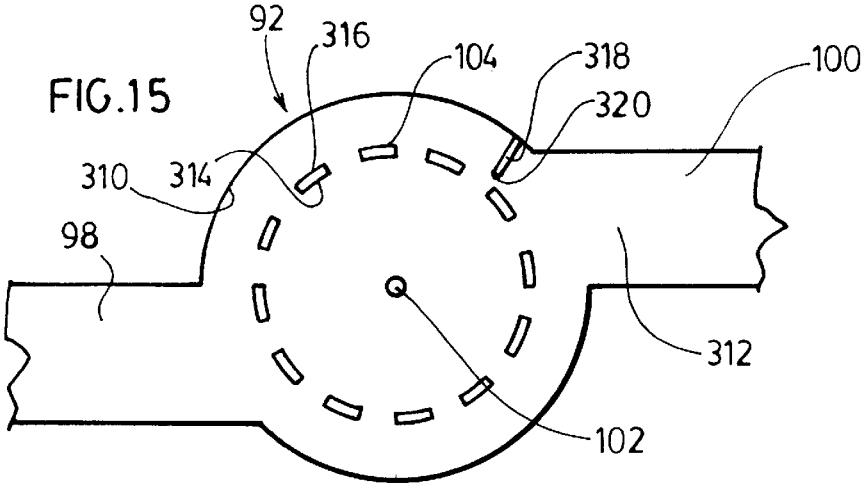

In another preferred embodiment, vacuum cleaner head 10 may have a first member having a cutting edge 318 and a second member co-operative with first member 318 for reducing the size of a portion of a particulate material entering dirty air inlet 40. Accordingly, if large material such as dog hair, large pieces of paper, and the like are introduced into housing 92, they may be reduced in size prior to exiting main turbine housing via outlet 100. While both first and second members may be movably mounted so as to cooperate to reduce a size of the particulate material, it is preferred, as shown in FIGS. 14 and 15, that first member 318 is mounted in a stationery position in casing 20. For example, as shown in FIG. 14, cutting member 318 is a longitudinally extending member which is mounted to inner surface 310 of main turbine housing 92. Cutting end 320 may comprise a sharpened end of first member 318. While only one first member 318 is shown in FIGS. 14 and 15, it will be appreciated that a plurality of such first members may be included within main turbine housing 92. Further, it will be appreciated that first member 318 need not be positioned adjacent inlet end 312 of outlet 100. A first member 318 may be positioned at any location in housing 92 where it will co-operate with, for example, blades 104 of main turbine 90 so as to reduce the size of particulate material and not unduly interfere with the passage of air and entrained dirt through main turbine housing 92.

In particular, as represented in FIG. 15, blades 104 have an inner surface 314 and an outer surface 316. Outer surface 316 and cutting end 320 may be configured in any way so as to provide a cutting or reducing action as particulate matter travels through housing 92. For example, blades 104 may be longitudinally extending members which extend parallel to drive shaft 102. Alternately, as shown in FIG. 14, blades 104 may be curved or helically extended members which have a first end 322 and a second end 324 which is rotationally displaced from first end 322. In this way, only a portion of a blade 104 will interact with cutting end 320 at any particular time thus decreasing the drag on turbine 92 produced by the co-operation of blades 104 and first member 318.

It will be appreciated by those skilled in the art that the various features of vacuum cleaner head 10 which are disclosed in herein may be combined by themselves in a vacuum cleaner head or in any particular permutation or combination. For example, the cutting means (first member 318 and second member (blades) 104), restricting member 200, the improved edge cleaning using edge cleaning air flow path 182, the movable housing 50, pressure sensor 110 to raise or lower brush 60 and/or housing 50 may be used individually, combined together in one vacuum cleaner head 10 or any subcombination thereof may be combined together in a vacuum cleaner head 10.

We claim:

1. A vacuum cleaner head for cleaning a surface comprising:

(a) a casing having a dirty air inlet for receiving an air flow having entrained particulate material, an air outlet and an air flow path extending between the dirty air inlet and the air outlet;

(b) a first member having a cutting edge and mounted in the casing, the cutting edge positioned in the air flow path; and, (c) a second member mounted in the casing for rotation in response to air flow through the air flow path and cooperative with the first member for reducing the size of a portion of the particulate material entering the dirty air inlet.

2. The vacuum cleaner head as claimed in claim 1 wherein the first member is mounted at a stationary position in the casing.

3. The vacuum cleaner head as claimed in claim 1 wherein the second member cooperates with the first member as it rotates.

4. The vacuum cleaner head as claimed in claim 1 wherein the second member comprises a turbine positioned in the air flow path and at least some of the blades of the turbine cooperate with the first member as the turbine rotates.

5. The vacuum cleaner head as claimed in claim 4 wherein the turbine is mounted in a housing, the housing has an outlet port and the first member comprises a knife which is mounted adjacent the outlet port.

6. The vacuum cleaner head as claimed in claim 4 further comprising a rotatably mounted brush which is drivenly connected to the turbine.

7. The vacuum cleaner head as claimed in claim 4 wherein the blades are positioned whereby at any one time at most only a portion of one of the blades is cooperativley disposed with respect to the first member.

8. The vacuum cleaner head as claimed in claim 7 wherein the turbine has a rotational axis and the blades comprise longitudinally extending members having a first end and a second end and the second end is displaced around the turbine with respect to the first end.

9. The vacuum cleaner head as claimed in claim 1 wherein the second member comprises an elongate member and at any one time at most only a portion of the second member cooperates with the first member.

10. A vacuum cleaner head for cleaning a surface comprising:

(a) a casing having a dirty air inlet for receiving an air flow having entrained particulate material, an air outlet and an air flow path extending between the dirty air inlet and the air outlet; and, (b) cutting means positioned in the air flow path for reducing the size of a portion of the particulate material as it flows past the cutting means, the cutting means comprising motive force means for producing motive power in response to the air flow through the vacuum cleaner head.

11. The vacuum cleaner head as claimed in claim 10 wherein the cutting means comprises a first cutting means and a second cutting means and the interaction of the first and second cutting means acts to reduce the size of a portion of the particulate material entering the dirty air inlet.

12. The vacuum cleaner head as claimed in claim 11 wherein the second cutting means comprises a plurality of cutting members configured such that at any one time at most only a portion of one of the cutting members is cooperativley disposed with respect to the first cutting means.

13. The vacuum cleaner head as claimed in claim 11 wherein the first cutting means is a stationary member and the second cutting means is the means for producing motive power.

14. The vacuum cleaner head as claimed in claim 13 wherein the means for producing motive power is a rotatably mounted member.

15. The vacuum cleaner head as claimed in claim 10 wherein the motive power is used to drive a brushing means.

16. A method of cleaning a surface using a vacuum cleaner head having a dirty air inlet, an air outlet, a motive force means for producing motive power in response to the air flow through the vacuum cleaner head and an air flow path there between, the method comprising:

(a) introducing dirty air having entrained particulate material into the dirty air inlet; and, (b) using the motive force means to reduce the size of a portion of the particulate material as it passes through the air flow path.

17. The method as claimed in claim 16 further comprising using the motive force means to operate a brushing means.

18. The method as claimed in claim 16 wherein the motive force means comprises a turbine and the method further comprises reducing the size of a portion of the particulate material as it passes by the turbine.

19. The method as claimed in claim 16 further comprising conveying the dirty air having entrained particulate matter from the air outlet to filtration means to remove particulate matter from the air.

20. A vacuum cleaner head for cleaning a surface comprising:

(a) a casing having a dirty air inlet for receiving an air flow having entrained particulate material, an air outlet and an air flow path extending between the dirty air inlet and the air outlet;

(b) a first member having a cutting edge and mounted in the casing, the cutting edge positioned in the air flow path;

(c) a turbine positioned in the air flow path and at least some of the blades of the turbine cooperate with the first member as the turbine rotates; and, (d) a rotatable mounted brush which is drivenly connected to the turbine whereby the size of a portion of the particulate material entering the dirty air inlet is reduced.

* * * * *